US008181955B2

(12) United States Patent
Massoud

(10) Patent No.: US 8,181,955 B2
(45) Date of Patent: May 22, 2012

(54) FEEDER DEVICE AND METHOD FOR MOVING PRINTED PRODUCTS BY PLANAR MOTION

(75) Inventor: Atef Tanious Massoud, Algonquin, IL (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 12/699,464

(22) Filed: Feb. 3, 2010

(65) Prior Publication Data

US 2011/0187048 A1 Aug. 4, 2011

(51) Int. Cl.

| | |
|---|---|
| ***B65H 29/54*** | (2006.01) |
| ***B65H 29/20*** | (2006.01) |
| ***B65H 5/30*** | (2006.01) |

(52) U.S. Cl. ..... 271/175; 271/314; 270/52.29; 270/52.26

(58) Field of Classification Search ..... 271/272, 271/225, 249, 264, 314, 175, 69, 306; 270/52.26, 270/52.25, 52.19, 52.29, 52.23, 52.16
See application file for complete search history.

(56) References Cited

U.S. PATENT DOCUMENTS

| | | | | |
|---|---|---|---|---|
| 4,085,927 | A * | 4/1978 | Muller | 270/52.29 |
| 4,775,137 | A * | 10/1988 | Glanzmann | 270/52.29 |
| 4,805,892 | A * | 2/1989 | Calhoun | 271/225 |
| 4,823,159 | A * | 4/1989 | Yamamoto et al. | 399/394 |
| 5,967,503 | A * | 10/1999 | Newsome | 270/52.04 |
| 6,581,930 | B2 * | 6/2003 | Kim | 271/272 |
| 6,619,650 | B2 | 9/2003 | Gysin et al. | |
| 6,830,242 | B2 | 12/2004 | Merkli | |
| 7,108,261 | B2 * | 9/2006 | Murakami et al. | 271/314 |
| 7,418,234 | B2 * | 8/2008 | Murakami et al. | 399/401 |
| 7,527,262 | B2 * | 5/2009 | Beckstrom | 271/225 |
| 2002/0060391 | A1 | 5/2002 | Mueller | |
| 2003/0047857 | A1 | 3/2003 | Peier | |
| 2003/0146567 | A1 * | 8/2003 | Williams et al. | 271/249 |
| 2005/0263958 | A1 * | 12/2005 | Knierim et al. | 271/272 |

* cited by examiner

*Primary Examiner* — Kaitlin Joerger
*Assistant Examiner* — Patrick Cicchino
(74) *Attorney, Agent, or Firm* — Davidson, Davidson & Kappel, LLC

(57) ABSTRACT

A feeder device for printed products is provided including at least one first drum rotatable about a first axis; at least one second drum rotatable about a second axis; and an actuator coupled to the at least one first drum and the at least one second drum for reciprocating the at least one first drum and the at least one second drum axially. A printed product conveying device and a method of transporting printed products are also provided.

21 Claims, 5 Drawing Sheets

FEEDER DEVICE AND METHOD FOR MOVING PRINTED PRODUCTS BY PLANAR MOTION

The present invention relates generally to feeder devices and more particular to feeder devices used in finishing equipment in the graphics industry to feed printed products to a moving conveyor.

BACKGROUND

In finishing equipment in the graphics industry, sheet feeder devices may drop signatures perpendicularly to a conveying apparatus, such as a chain conveyor, moving below the feeder device. Signatures leaving the feeder grippers may only be moving downwards and are not translated tangentially with respect to the conveying apparatus (i.e., in the horizontal direction). So, just before the signatures contact the conveying apparatus the signatures may have a tangentially velocity of zero. When each signature contacts the conveying apparatus, due to the velocity difference the signature may slide a very small distance, then begin traveling at the same tangential velocity as the surface of the conveying apparatus. Conveying apparatuses may have lugs to positively register and align the signatures. The immediate tangential acceleration of the signatures by the conveying apparatus may cause the lugs or the surface of the conveying apparatus to mark or damage the signatures. As a result, the velocity of the conveying apparatuses may sometimes be limited to minimize the tangential velocity difference between the signatures and the conveying apparatus.

FIG. 1 schematically shows a perspective view of a conventional signature transporting device 110. Signature conveying device 110 includes a feeder device 112 and a collecting apparatus 114. Feeder device 112 includes a pair of transfer drums 116, 118 rotatable in one direction about a first axis 120 and a pair of opposing transfer drums 126, 128 rotatable in the opposite direction about a second axis 130. Drums 116, 118 may have grippers that grip an open edge of a folded signature and drums 126, 128 may have grippers that grip the other open edge of the folded signature. Drums 116, 118, 126, 128 may receive the open edges of each signature first and transport the signature downward while moving the open edges away from one another to open the signature. The signature is then released downwardly by the drums 116, 118, 126, 128 to collecting apparatus 114, which may be a chain or a saddle conveyor.

Axes 120, 130 are aligned horizontally with respect to a direction Y and drums 116, 118, 126, 128 transport signatures vertically downward in a direction Z. Collecting apparatus 114 receives signatures traveling vertically downward in direction Z and transports the signatures horizontally in direction Y. Axes 120, 130 are rotatably fixed in position, such that drums 116, 118, 126, 128 are not translatable in a direction X, direction Y or direction Z. Therefore, drums 116, 118, 126, 128 only convey signatures in direction Z and just before signatures contact collecting apparatus 114, signatures have no velocity in direction Y.

SUMMARY OF THE INVENTION

A feeder device for printed products is provided including at least one first drum rotatable about a first axis; at least one second drum rotatable about a second axis; and an actuator coupled to the at least one first drum and the at least one second drum for reciprocating the at least one first drum and the at least one second drum axially.

A printed product conveying device is also provided including a device for transporting printed products in a first direction; a conveyor downstream from the device traveling in a direction perpendicular to the first direction for receiving the printed products from the device; and an actuator coupled to the device for translating the device in the second direction.

A method of transporting printed products including the steps of receiving a printed product and transporting the printed product in a first direction with at least one first drum rotating about a first axis and at least one second drum rotating about a second axis; translating the at least one first drum and the at least one second drum in a second direction that corresponds to a direction of the first axis and a direction of the second axis to accelerate the printed product in the second direction; and releasing the printed product from the at least one first drum and the at least one second drum to a conveyor traveling in the second direction.

BRIEF DESCRIPTION OF THE DRAWINGS

The present invention is described below by reference to the following drawings, in which.

DETAILED DESCRIPTION

Figure 1:
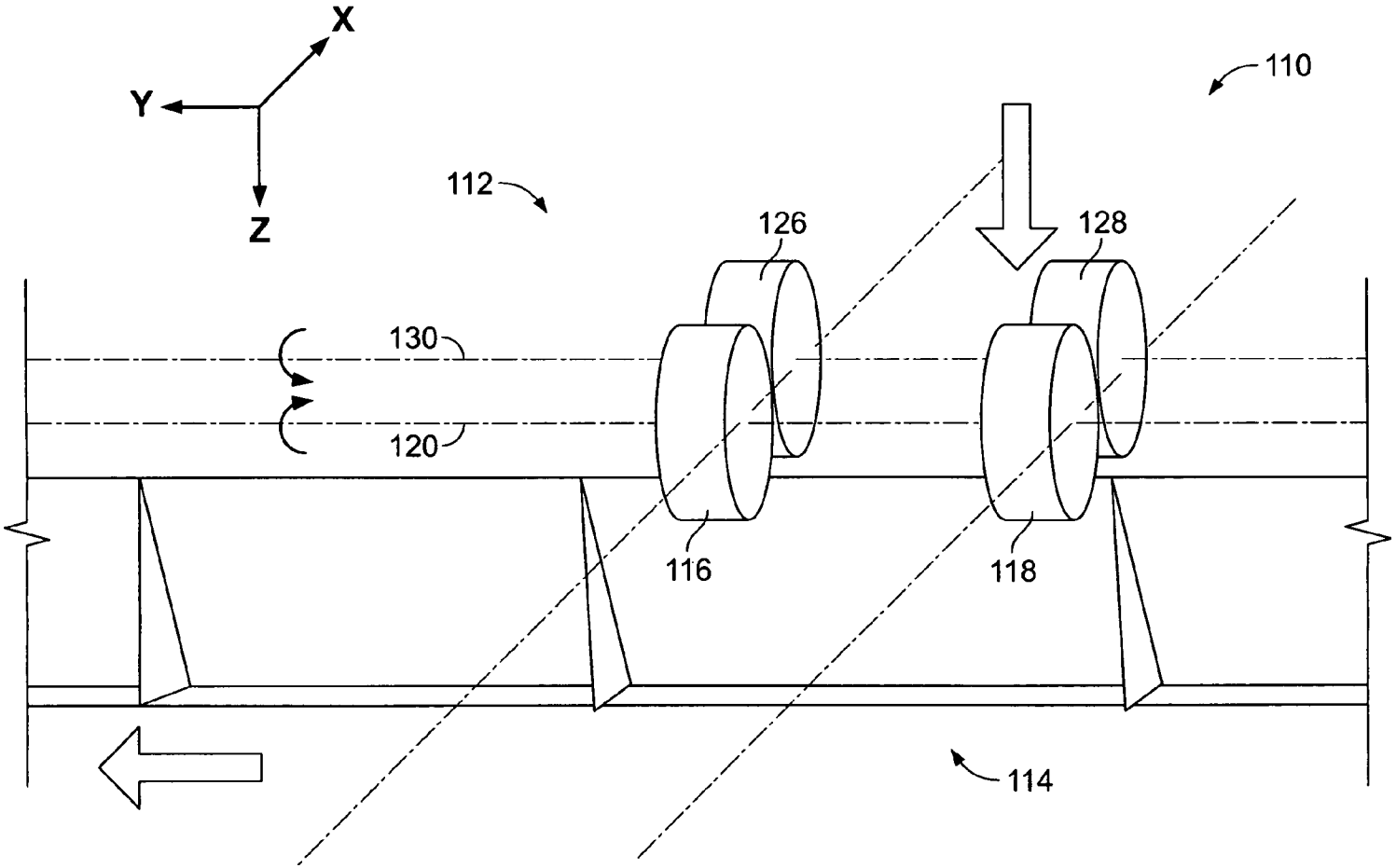
Prior Art FIG. 1
FIG. 1 schematically shows a portion of a conventional signature transporting device.
Figure 2:
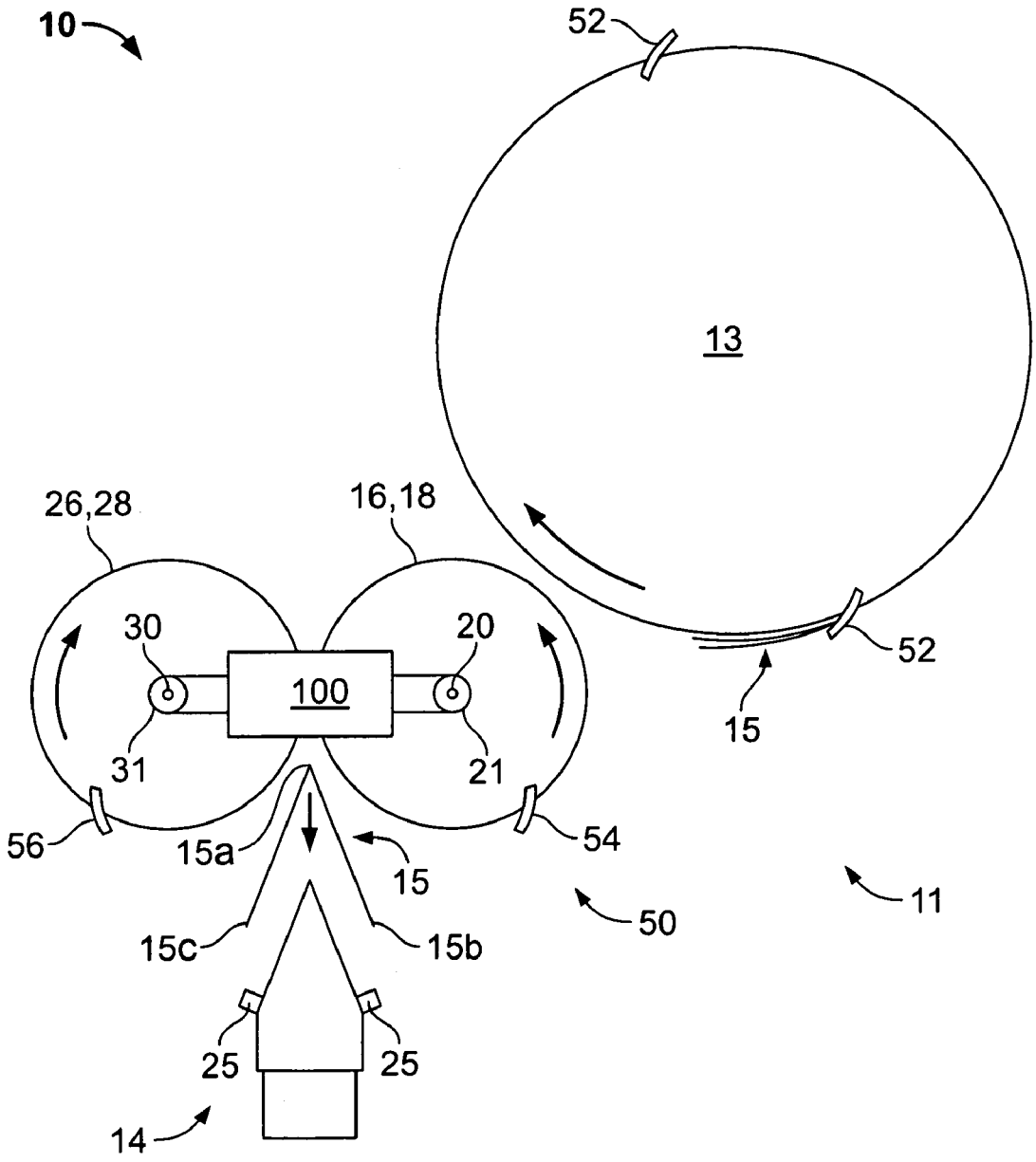
FIG. 2 schematically shows a signature transporting device in accordance with an embodiment of the present invention.

FIG. 2 schematically shows a side view of a signature transporting device 10 according to an embodiment of the present invention. Signature transporting device 10 includes a feeder 11, which includes pick-up drum 13 and a dual direction conveying apparatus 50, and a conveyor, which in this embodiment is a saddle conveyor 14. Pick-up drum 13 may include a suction device and grippers 52 and may pull folded signatures 15 from a signature stack. Dual direction conveying apparatus 50 may include first transfer drums 16, 18, second transfer drums 26, 28 and an actuator 100. In an alternative embodiments, first transfer drums 16, 18 may be replaced by a single transfer drum or more than two transfer drums and second transfer drums 26, 28 may be replaced by a single transfer drum or more than two transfer drums. Pick-up drum 13 may rotate in a first direction (e.g., clockwise) to grip a folded edge 15*a* of each signature 15 and pass each signature 15 to first transfer drums 16, 18 by open edges 15*b*, 15*c*. First transfer drums 16, 18 may include at least one gripper 54 to receive signatures 15 from pick-up drum 14. First transfer drums 16, 18 may be fixedly coupled to a shaft 21 rotatable in a second direction (e.g., counterclockwise) about an axis 20 to grip one or both of open edges 15*b*, 15*c* and transport each signature 15 towards second transfer drums 26, 28. Second transfer drums 26, 28, which may include at least one gripper 56, may be fixedly coupled to a shaft 31 rotatable in the first direction (e.g., clockwise) about an axis 30. Second transfer drums grip open edge 15*c* as first transfer drums 16, 18 grip open edge 15*b* and via rotation, transfer drums 16, 18, 26, 28 open each signature 15. Open signatures 15 are released downward to saddle conveyor 14 so that open edges 15*b*, 15*c* straddle saddle conveyor 14. Saddle conveyor 14 is traveling perpendicular to signature 15 (e.g., out of the page) in direction Y (FIG. 3) and may include lugs 25.

Figure 3:
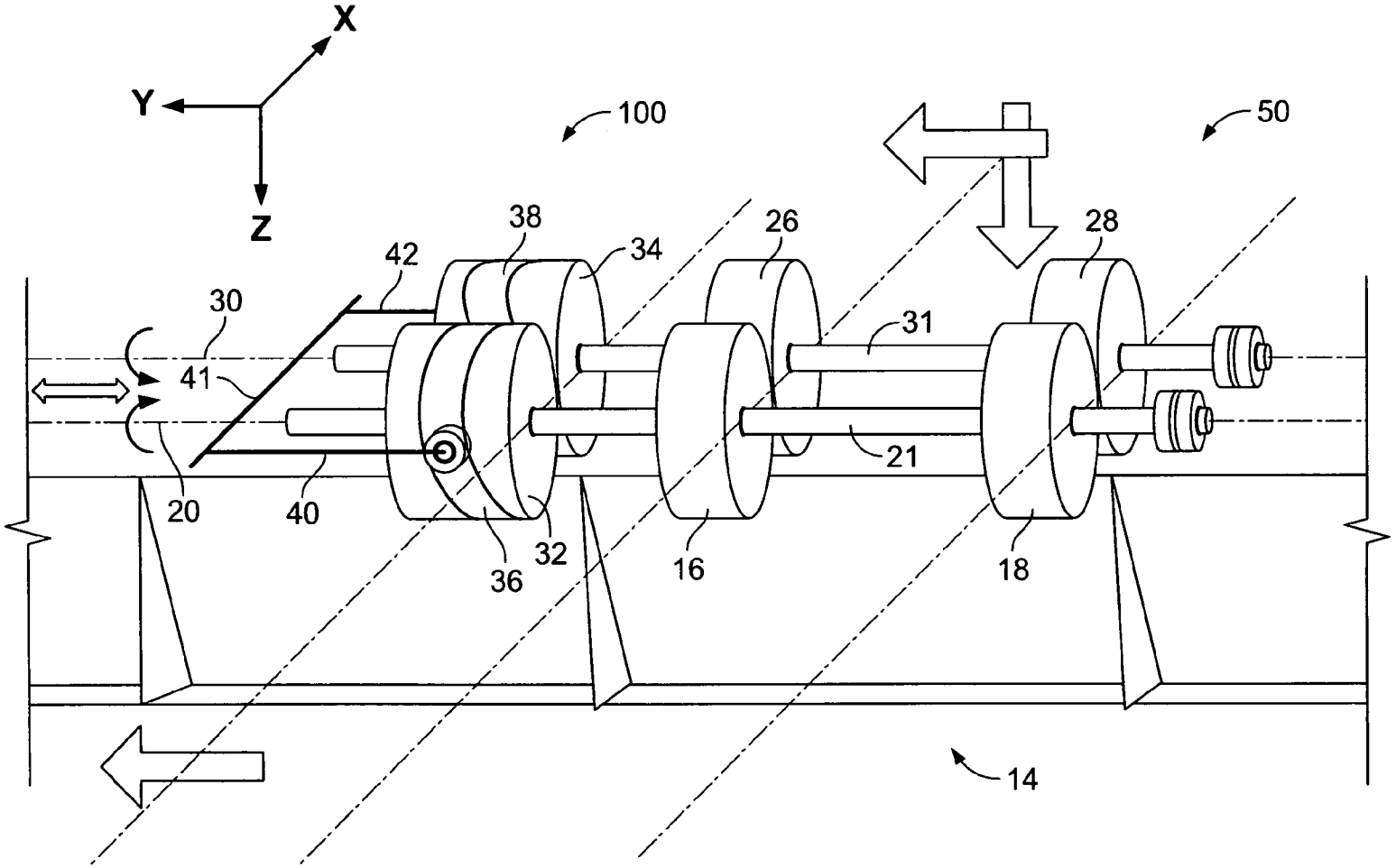
FIG. 3 schematically shows a perspective view of a dual direction conveying apparatus and a saddle conveyor of the signature transporting device shown in FIG. 2.

After pick-up drum 13 releases each signature 15 to first transfer drums 16, 18, actuator 100, which is coupled to shafts 21, 31, may translate transfer drums 16, 18, 26, 28 in the direction of travel of saddle conveyor 14 (e.g., out of the page). In a preferred embodiment, after signature 15 is released to first transfer drums 16, 18 by pick-up drum 13, actuator 100 may accelerate drums 16, 18, 26, 28 from a zero velocity in direction Y (FIG. 3). Actuator 100 may accelerate drums 16, 18, 26, 28 up to a velocity of an outer surface of saddle conveyor 14 for the release of signature 15 to saddle conveyor 14. As a result, each signature 15 may travel at the same velocity as the outer surface of saddle conveyor 14 as each signature 15 contacts the outer surface of saddle conveyor 14. After one signature 15 is released by drums 16, 18, 26, 28, actuator 100 translates drums 16, 18, 26, 28 back into the initial position for receiving another signature 15 from pick-up drum 13.

FIG. 3 schematically shows a perspective view of dual direction conveying apparatus 50 and saddle conveyor 14 shown in FIG. 2. Transfer drums 16, 18 are rotatable in the second direction (e.g., counterclockwise) about axis 20 and transfer drums 26, 28 are rotatable in the first direction (e.g., clockwise) about axis 30. Drums 16, 18, 26, 28 may receive signatures 15 (FIG. 2), and transport each signature 15 (FIG. 2) downward to saddle conveyor 14 in an open arrangement.

Axes 20, 30 are aligned horizontally with respect to direction Y and drums 16, 18, 26, 28 transport successive signatures 15 (FIG. 2) vertically downward in direction Z. Saddle conveyor 14 receives each signature 15 (FIG. 2) traveling vertically downward in direction Z and transports each signature 15 (FIG. 2) horizontally in direction Y. Shafts 21, 31 are configured such that drums 16, 18, 26, 28 are translatable in direction Y. Therefore, dual direction conveying apparatus 50 may convey signatures in direction Y and direction Z.

Shafts 21, 31 are translatable in direction Y by actuator 100, which may include two cylindrical cams 32, 34 having respective grooves 36, 38 for cam followers 40, 42. Grooves 26, 28 may extend between the ends of the respective cams 32, 34 so that cams 32, 34 may be axially displaced during rotation. Cam followers 40, 42, which may be coupled together via a connector 41, are fixed in position, for example via a connection to a side support frame. As cams 32, 34 rotate about respective axes 20, 30 cam followers 40, 42, via interaction with grooves 36, 38 cause cams 32, 34, shafts 21, 31, and drums 16, 18, 26, 28 to reciprocate in direction Y. Ends of shafts 21, 31 may rotate in bearings that are configured to allow shafts 21, 31 to be axially reciprocated by the interactions between cam followers 40, 42 and cams 32, 34. In order to accelerate signatures 15 (FIG. 2), cams 32, 34 are phased such that portions of grooves 36, 38 that are closest to drums 16, 18, 26, 28 interact with cam followers 40, 42 as drums 16, 18 receive signatures 15 and portions of grooves 36, 38 that are furthest from drums 16, 18, 26, 28 interact with cam followers 40, 42 as drums 16, 18 release signatures. Grooves 36, 38 (i.e., profiles of cams 32, 34) may be varied in design to dictate the velocity in direction Y that signatures 15 (FIG. 2) are released from drums 16, 18, 26, 28 to saddle conveyor 14 and the duration that drums 16, 18, 26, 28 are in each position through the axial reciprocation (i.e., signature receiving position and signature releasing position).

In an alternative embodiment, a single cam follower may be positioned between cams 32, 34 for interacting with both grooves 36, 38 to reciprocate shafts 21, 31 as cams 32, 34, shafts 21, 31, and drums 16, 18, 26, 28 are rotated.

In order to convert dual direction conveying apparatus 50 into conventional form, such that drums 16, 18, 26, 28 are not reciprocated in direction Y during rotation, cam followers 40, 42 may simply be disengaged from cams 32, 34.

Figure 4:
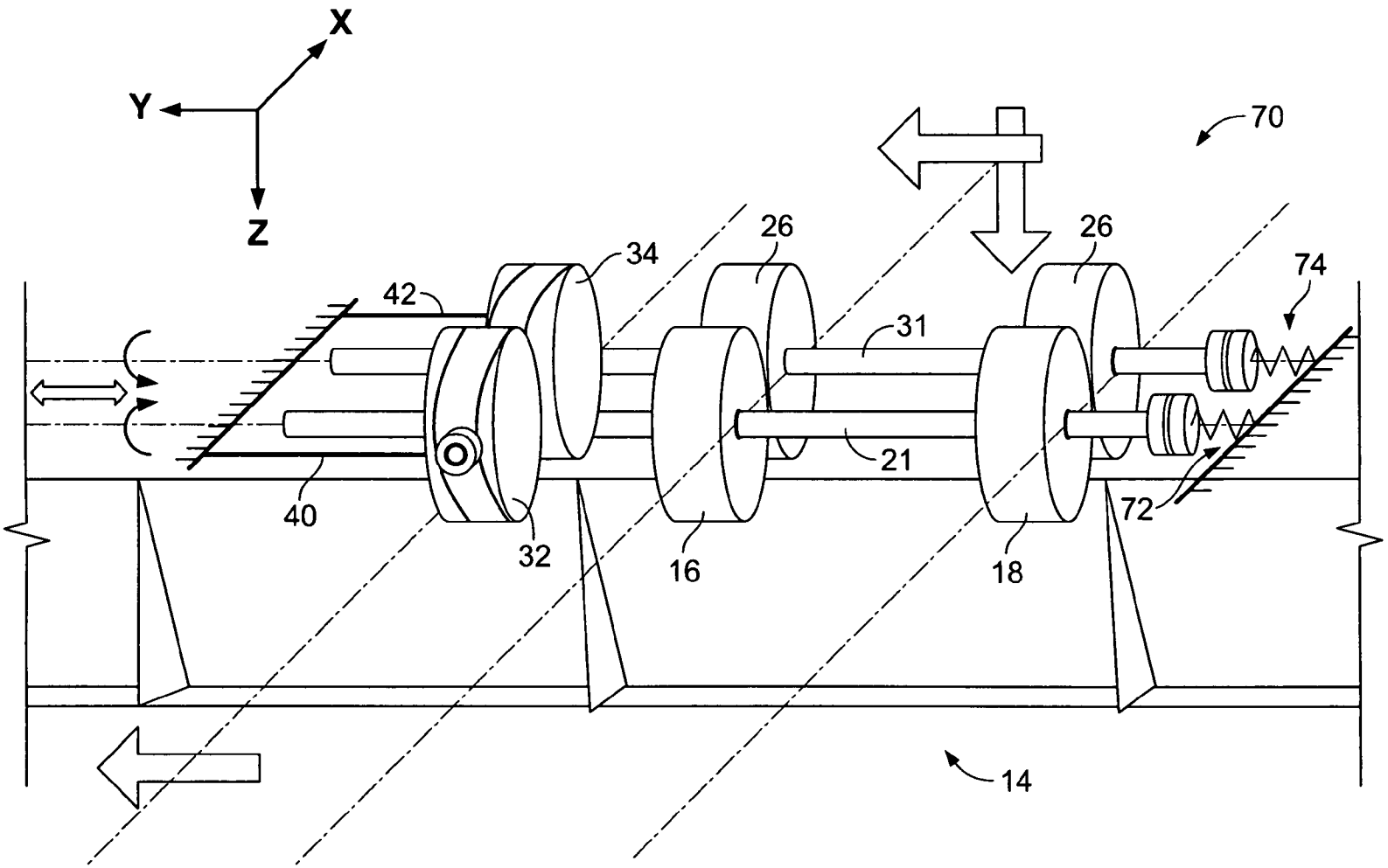
FIG. 4 schematically shows a perspective view of a dual direction conveying apparatus according to an embodiment of the present invention.

FIG. 4 schematically shows a perspective view of a dual direction conveying apparatus 70 according to another embodiment of the present invention. Dual direction conveying apparatus 70 is configured in substantially the same manner as dual direction conveying apparatus 50 shown in FIGS. 2 and 3, except that shafts 21, 31 are each coupled to respective resilient elements, which in this embodiment are return springs 72, 74 that provide a force on cams 32, 34 and cam followers 40, 42, acting to center drums 16, 18, 26, 28 and maintaining positive contact between cam followers 40, 42 and respective cams 32, 34.

Figure 5:
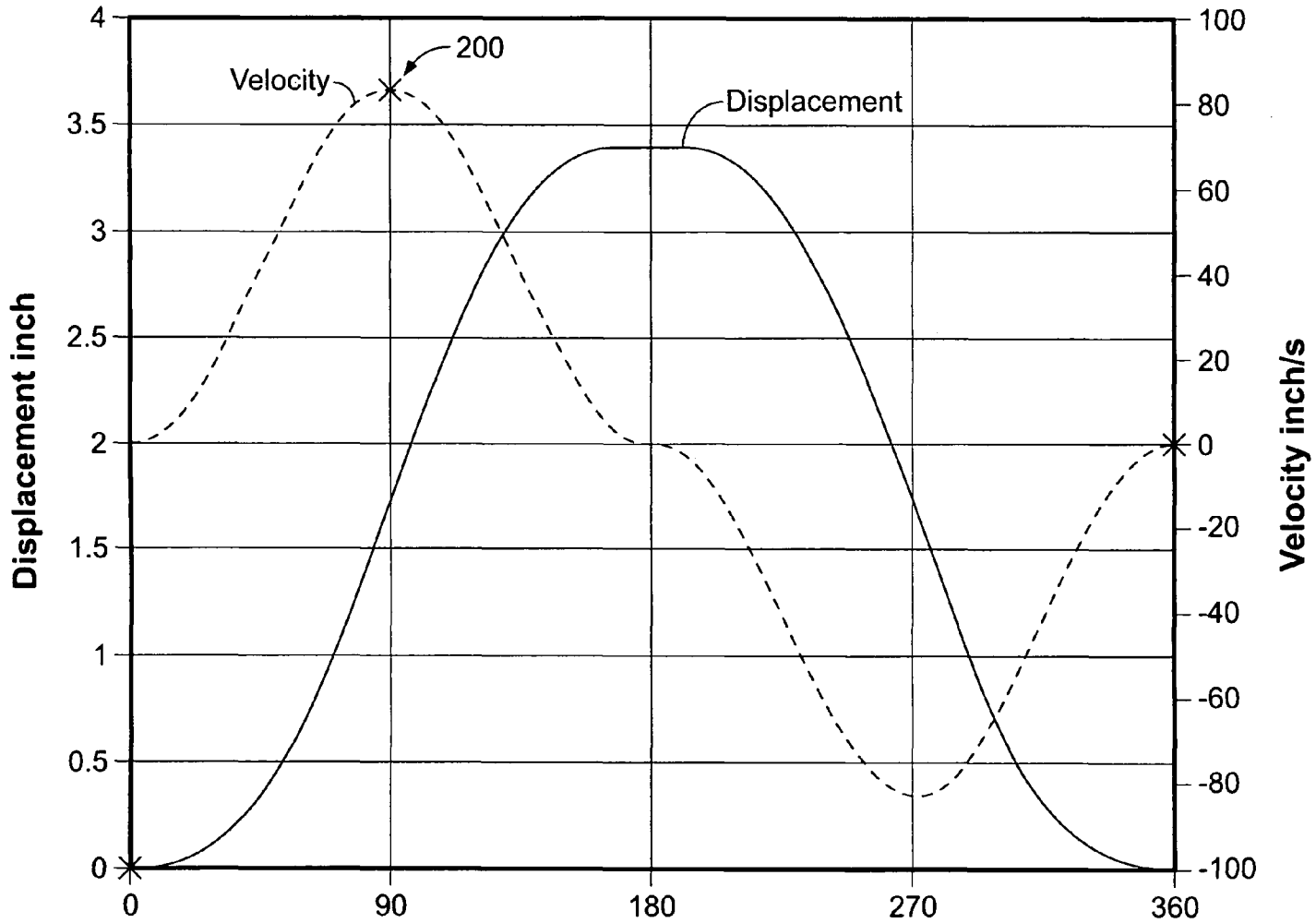
FIG. 5 shows shows a graph of a displacement and velocity of drums shown in FIGS. 2 to 4 versus positions of cams shown in FIGS. 2 to 4 for a cam profile according to an embodiment of the present invention.

FIG. 5 shows a graph of a displacement and velocity of drums 16, 18, 26, 28 by cams 32, 34 and cam followers 40, 42 of actuator 100 shown in FIGS. 2 to 4 versus positions of cams 32, 34 for a cam profile according to an embodiment of the present invention. For this cam profile, a quarter revolution of cams 32, 34 is used to accelerate drums 16, 18, 26, 28 and a signature gripped by drums 16, 18, 26, 28 to a velocity of conveyer 14, at which time drums 16, 18, 26, 28 release the signature, which is illustrated in FIG. 5 as release point 200. A next quarter revolution of cams 32, 34 is used to decelerate shafts 21, 31 and drums 16, 18, 26, 28 to a zero velocity. A third quarter revolution is used to accelerate shafts 21, 31 and drums 16, 18, 26, 28 in the opposite direction and a fourth quarter revolution is used to decelerate shafts 21, 31 and drums 16, 18, 26, 28 so drums 16, 18, 26, 28 can receive and transport a subsequent signature.

In other embodiments, different cams with different profiles may be used. For example, cams may be provided that only accelerate drums to a percentage of the velocity of saddle conveyor 14, to minimize, but not completely eliminate the tangential velocity difference between saddle conveyor 14 and signatures.

The following equations may be used to match 100% of the tangential velocity of saddle conveyor 14 using a cycloidal cam profile.

$$y=L/\pi[\theta-\tfrac{1}{2}\sin(2\theta)] \quad \text{(equation 1);}$$

$$y'=L/\pi[\theta-\cos(2\theta)] \quad \text{(equation 2);}$$

$$y''=2L/\pi[\sin(2\theta)] \quad \text{(equation 3);}$$

$$y'''=4L/\pi[\cos(2\theta)] \quad \text{(equation 4);}$$

$$y'=dy/d\theta \quad \text{(equation 5);}$$

$$y^*=dy/dt=dy/d\theta*d\theta/dt=y'\omega \quad \text{(equation 6);}$$

where:

L=cam rise;

θ=cam angle;

ω=cam angular velocity;

y=cam displacement;

y*=cam velocity (tangential velocity);

y'=rate of change of y with respect to θ;

y"=rate of change of y' with respect to θ; and y'"=rate of change of y" with respect to θ.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A feeder device for printed products comprising:

at least one first drum rotatable about a first axis, the at least one first drum including at least one first gripper;

at least one second drum rotatable about a second axis, the at least one second drum including at least one second gripper, the at least one first gripper and the at least one second gripper opening printed products passing between the at least one first drum and the at least one second drum; and an actuator coupled to the at least one first drum and the at least one second drum for reciprocating the at least one first drum and the at least one second drum axially.

2. The feeder device recited in claim 1 further comprising a first shaft coincident with the first axis coupled to the at least one first drum and a second shaft coincident with the second axis coupled to the at least one second drum.

3. The feeder device recited in claim 2 wherein the actuator includes a first cam coupled to the first shaft and a first cam follower for axially displacing the first cam.

4. The feeder device recited in claim 3 wherein the actuator further includes a second cam coupled to the second shaft and a second cam follower for axially displacing the second cam.

5. The feeder device recited in claim 4 further comprising at least one resilient element coupled to the first shaft and the second shaft for maintaining positive contact between the first cam and the first cam follower and between the second cam and the second cam follower.

6. A printed product conveying device comprising:

a device, including at least one gripper, for opening and transporting printed products downward in a first direction;

a conveyor positioned directly, vertically below and downstream from the device traveling in a second direction perpendicular to the first direction for receiving the printed products from the device; and an actuator coupled to the device for translating the device in the second direction.

7. The printed product conveying device recited in claim 6 wherein the actuator includes at least one cam and at least one cam follower.

8. The printed product conveying device recited in claim 6 wherein the device includes at least one first drum rotatable about a first axis and at least one second drum rotatable about a second axis and the actuator is for translating the at least first drum and the at least second drum axially.

9. The printed product conveying device recited in claim 8 further comprising a first shaft coupling the at least one first drum to the actuator and a second shaft coupling the at least one second drum to the actuator.

10. The printed product conveying device recited in claim 9 wherein the actuator includes a first cam coupled to the first shaft and a second cam coupled to the second shaft.

11. The printed product conveying device recited in claim 10 wherein the actuator further includes at least one cam follower fixed in position with respect to the first cam and the second cam for interacting with the first cam and the second cam to translate the first shaft and the second shaft as the at least one first drum rotates about the first axis and the at least one second drum rotates about the second axis.

12. The printed product conveying device recited in claim 6 wherein the actuator is adapted to translate the drums in the second direction so that the printed products transported in the first direction are traveling in the second direction when the printed products are received by the conveyor.

13. The printed product conveying device recited in claim 6 further comprising at least one resilient element coupled to the device for providing a force on the actuator.

14. The printed product conveying device recited in claim 6 wherein the conveyor is a saddle conveyor.

15. A method of transporting printed products comprising:

receiving a printed product and transporting the printed product in a first direction with at least one first drum rotating about a first axis and at least one second drum rotating about a second axis;

translating the at least one first drum and the at least one second drum in a second direction that corresponds to a direction of the first axis and a direction of the second axis to accelerate the printed product in the second direction; and releasing the printed product from the at least one first drum and the at least one second drum to a conveyor traveling in the second direction;

wherein the printed product is folded at a folded edge and has a first open edge and a second open edge and the printed product is released to the conveyor so that the first and second edges straddle the conveyor.

16. The method recited in claim 15 wherein the translating step includes translating the at least one first drum and the at least one second drum via at least one cam and at least one cam follower.

17. The method recited in claim 16 wherein the at least one cam includes a first cam and a second cam and the actuating step includes rotating the first cam about the first axis and the second cam about the second axis.

18. The method recited in claim 17 wherein the actuating step further includes contacting the at least one cam follower with the first cam and second cam while rotating the first cam about the first axis and the second cam about the second axis.

19. The method recited in claim 15 further comprising conveying the printed products with the conveyor in the second direction.

20. The method recited in claim 15 wherein the printed product is traveling at a predetermined velocity in the second direction as the printed product is released from the at least one first drum and the at least one second drum.

21. A method of transporting printed products comprising:

receiving a printed product and transporting the printed product in a first direction with at least one first drum rotating about a first axis and at least one second drum rotating about a second axis;

translating the at least one first drum and the at least one second drum in a second direction that corresponds to a direction of the first axis and a direction of the second axis to accelerate the printed product in the second direction; and releasing the printed product from the at least one first drum and the at least one second drum to a conveyor traveling in the second direction;

wherein the printed product is traveling at a predetermined velocity in the second direction as the printed product is released from the at least one first drum and the at least one second drum;

wherein the predetermined velocity of the printed product is equal to a velocity of the conveyor moving in the second direction.

* * * * *